US010513749B2

(12) United States Patent
Toyoda et al.

(10) Patent No.: US 10,513,749 B2
(45) Date of Patent: Dec. 24, 2019

(54) HOT-ROLLED STEEL SHEET AND PRODUCTION METHOD OF THEREFOR

(71) Applicant: NIPPON STEEL & SUMITOMO METAL CORPORATION, Tokyo (JP)

(72) Inventors: Takeshi Toyoda, Kisarazu (JP); Riki Okamoto, Chiba (JP); Ryohta Niiya, Himeji (JP); Hiroshi Sakai, Kobe (JP); Hidetoshi Shindo, Himeji (JP)

(73) Assignee: NIPPON STEEL CORPORATION, Tokyo (JP)

( * ) Notice: Subject to any disclaimer, the term of this patent is extended or adjusted under 35 U.S.C. 154(b) by 452 days.

(21) Appl. No.: 15/313,484

(22) PCT Filed: May 28, 2014

(86) PCT No.: PCT/JP2014/064150
§ 371 (c)(1),
(2) Date: Nov. 22, 2016

(87) PCT Pub. No.: WO2015/181911
PCT Pub. Date: Dec. 3, 2015

(65) Prior Publication Data

US 2017/0159149 A1 Jun. 8, 2017

(51) Int. Cl.

| | |
|---|---|
| ***C21D 9/46*** | (2006.01) |
| ***C21D 1/60*** | (2006.01) |
| ***C21D 1/613*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/28*** | (2006.01) |
| ***C22C 38/38*** | (2006.01) |
| ***B22D 11/00*** | (2006.01) |

(52) U.S. Cl.
CPC ..... *C21D 9/46* (2013.01); *B22D 11/001* (2013.01); *C21D 1/60* (2013.01); *C21D 1/613* (2013.01); *C21D 8/02* (2013.01); *C21D 8/0221* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/28* (2013.01); *C22C 38/38* (2013.01)

(58) Field of Classification Search
None
See application file for complete search history.

(56) References Cited

U.S. PATENT DOCUMENTS

| | | | | |
|---|---|---|---|---|
| 2002/0007882 | A1* | 1/2002 | Inoue | C21D 8/0226 148/541 |
| 2006/0113012 | A1 | 6/2006 | Okamoto et al. | |
| 2012/0118439 | A1 | 5/2012 | Ono et al. | |
| 2013/0000791 | A1 | 1/2013 | Takahashi et al. | |
| 2013/0008568 | A1 | 1/2013 | Suwa et al. | |
| 2014/0000769 | A1 | 1/2014 | Takahashi et al. | |
| 2014/0102596 | A1 | 4/2014 | Ono et al. | |
| 2014/0110022 | A1 | 4/2014 | Sano et al. | |
| 2014/0124101 | A1 | 5/2014 | Suwa et al. | |
| 2014/0144553 | A1 | 5/2014 | Hata et al. | |
| 2015/0017471 | A1 | 1/2015 | Shuto et al. | |
| 2015/0284818 | A1* | 10/2015 | Toyoda | C23C 2/02 428/659 |
| 2018/0327878 | A1* | 11/2018 | Toyoda | C22C 38/02 |

FOREIGN PATENT DOCUMENTS

| | | | |
|---|---|---|---|
| CA | 2851325 | A1 | 5/2013 |
| CA | 2880063 | A1 | 2/2014 |
| CN | 100345993 | C | 10/2007 |
| CN | 102791896 | A | 11/2012 |
| CN | 103429779 | A | 12/2013 |
| EP | 0 969 112 | A1 | 1/2000 |
| JP | 11-61327 | A | 3/1999 |
| JP | 2002-115025 | A | 4/2002 |
| JP | 2005-120438 | A | 5/2005 |
| JP | 2005-213643 | A | 8/2005 |
| JP | 2005-256020 | A | 9/2005 |
| JP | 2005-272988 | A | 10/2005 |
| JP | 2008-138270 | A | 6/2008 |

(Continued)

OTHER PUBLICATIONS

Chinese Office Action and Search Report, dated Aug. 2, 2017, for corresponding Chinese Application No. 201480079185.8, with English translations.
International Search Report for PCT/JP2014/064150 dated Aug. 12, 2014.
Office Action for JP 2013-010148 dated Mar. 10, 2015.
Office Action for TW 103118609 dated Oct. 23, 2015.
Written Opinion of the International Searching Authority for PCT/JP2014/064150 (PCT/ISA/237) dated Aug. 12, 2014.
Extended European Search Report for corresponding European Application No. 14893619.8, dated Oct. 11, 2017.
Brazilian Office Action for counterpart Brazilian Application No. BR112016027395-8, dated Jul. 9, 2019, with English translation.

(Continued)

*Primary Examiner* — Helene Klemanski
(74) *Attorney, Agent, or Firm* — Birch, Stewart, Kolasch & Birch, LLP

(57) ABSTRACT

A hot-rolled steel sheet has predetermined chemical composition, a sum of a Si content and an Al content is higher than 0.20% and lower than 0.81%, a microstructure includes, by area fraction, 90% to 99% of a ferrite, 1% to 10% of a martensite, and a bainite limited to 5% or less, the grain size of the martensite is 1 to 10 μm, the X-ray random intensity ratio of a {211}<011> orientation which is parallel to a rolled surface of the steel sheet and is parallel to a rolling direction is 3.0 or less.

4 Claims, 2 Drawing Sheets

(56) References Cited

FOREIGN PATENT DOCUMENTS

| | | | |
|---|---|---|---|
| JP | 2009-7660 | A | 1/2009 |
| JP | 2011-26699 | A | 2/2011 |
| JP | 2011-47038 | A | 3/2011 |
| JP | 2011-111674 | A | 6/2011 |
| JP | 2011-184788 | A | 9/2011 |
| JP | 2011-214071 | A | 10/2011 |
| JP | 2012-52236 | A | 3/2012 |
| JP | 2012-233229 | A | 11/2012 |
| JP | 2013-227603 | A | 11/2013 |
| JP | 2014-37594 | A | 2/2014 |
| TW | 201335383 | A1 | 3/2012 |
| TW | 201303038 | A1 | 1/2013 |
| WO | WO 2011/142356 | A1 | 11/2011 |
| WO | WO 2012/026419 | A1 | 3/2012 |
| WO | WO 2012/128228 | A1 | 9/2012 |

OTHER PUBLICATIONS

Senuma et al., "Influence of Hot Rolling and Cooling Conditions on the Grain Refinement of Hot Rolled Extralow-carbon Steel Bands," ISIJ International, vol. 38, No. 6, 1998, pp. 587-594.

* cited by examiner

HOT-ROLLED STEEL SHEET AND PRODUCTION METHOD OF THEREFOR

TECHNICAL FIELD OF THE INVENTION

The present invention relates to a high strength hot-rolled steel sheet which has excellent external appearance and excellent balance between elongation and hole expansibility and has a tensile strength of 590 MPa or higher, and a production method of therefor.

RELATED ART

In recent years, for the purpose of an improvement in the fuel efficiency of a vehicle and an enhancement in collision safety, a reduction in the weight of the vehicle body has been actively achieved by the application of a high strength steel sheet. In a case where a high strength steel sheet is applied to the vehicle body or the like of a vehicle, it is important to secure press formability. In addition, for example, for an enhancement in surface designability of a vehicle wheel disk, it is required to eliminate Si scale patterns as much as possible. In addition, since elongating and burring are performed, a steel sheet as a material requires excellent external appearance and high elongation and hole expansibility.

Patent Document 1 suggests a hot-rolled steel sheet in which the structure fraction of martensite is 3% or higher and lower than 10%. In Patent Document 1, it is disclosed that a hot-rolled steel sheet having excellent balance between elongation and hole expansibility is obtained by enhancing strength through precipitation strengthening of ferrite using Ti and Nb.

Patent Document 2 discloses a steel which has a combined structure of ferrite and martensite in which the proportion of the ferrite in a microstructure is caused to be 40% or higher by adding Al thereto in order to prevent the generation of Si scale, which is a cause of deterioration of chemical conversion properties.

PRIOR ART DOCUMENT

Patent Document

[Patent Document 1] Japanese Unexamined Patent Application, First Publication No. 2011-184788

[Patent Document 2] Japanese Unexamined Patent Application, First Publication No. 2005-120438

DISCLOSURE OF THE INVENTION

Problems to be Solved by the Invention

In the technique described in Patent Document 1, Ti or Nb is added for precipitation strengthening of ferrite. Therefore, a texture is developed during hot-rolling, and plastic anisotropy of the ferrite becomes strong. As a result, sufficient hole expansibility cannot be obtained.

In addition, in the technique described in Patent Document 1, 0.5% or more of Si is added. Therefore, due to scale generated during hot-rolling, a stripe pattern (hereinafter, referred to as scale pattern) is generated in the steel sheet, and excellent external appearance cannot be obtained.

In the technique described in Patent Document 2, external appearance or chemical conversion properties are enhanced by adding Al as an alternative to Si to a steel sheet. However, when Al is added, a ferrite transformation start temperature becomes a high temperature, and coarse ferrite and martensite are formed. As a result, in the steel sheet described in Patent Document 2, cracking easily occurs at the interface between the ferrite and the martensite, and elongation and hole expansibility are insufficient.

In view of the above-described circumstances, an object of the present invention is to provide a high strength hot-rolled steel sheet which has excellent external appearance and excellent balance between elongation and hole expansibility and has a tensile strength of 590 MPa or higher, and a production method of therefor.

In the present invention, excellent external appearance indicates less generation of scale patterns on a surface, and excellent balance between elongation and hole expansibility indicates an elongation of 20% or higher and a hole expansion ratio of 100% or higher, which are simultaneous.

Means for Solving the Problem

The inventors conducted various examinations on means for solving the problems.

When a microstructure contains martensite, strength is enhanced, but a reduction in hole expansibility is a concern. Therefore, in order to enhance strength, using precipitation strengthening of Ti or Nb instead of the enhancement in the strength by martensite (transformation strengthening) is considered. However, when Ti or Nb is contained, a texture is formed during hot-rolling.

In addition, in order to improve external appearance, when Al is contained as an alternative to Si, which is a cause of generation of scale patterns, coarse martensite is formed, resulting in a deterioration in hole expansibility. The inventors newly found that it is important to control an austenitic structure immediately before transformation in order to solve these two problems.

Specifically, it was found that by causing a rolling reduction to be 20% or higher in the final pass of finish rolling and by causing a finish rolling temperature to be 880° C. to 1000° C., recrystallization of austenite can be promoted, and accordingly, an improvement in a texture can be achieved. Furthermore, it was found that by starting water cooling of a steel sheet at a time between 0.01 seconds to 1.0 seconds after the end of the finish rolling, the recrystallization can be completed within a short period of time, and accordingly, finely recrystallized austenite can be made. During transformation from the finely recrystallized austenite, there are many ferrite nucleation sites, and transformation rapidly proceeds. Therefore, by performing air cooling after the completion of the cooling, fine ferrite is formed, and residual austenite during air cooling finely remains. As a result, it becomes possible to refine martensite after the transformation.

The present invention was obtained on the basis of the above-described knowledge. The gist of the present invention is as follows.

(1) That is, according to an aspect of the present invention, a hot-rolled steel sheet includes, as chemical composition, by mass %: C: 0.02% to 0.10%, Si: 0.005% to 0.1%, Mn: 0.5% to 2.0%, P: 0.1% or less, S: 0.01% or less, Al: 0.2% to 0.8%, N: 0.01% or less, Ti: 0.01% to 0.11%, Nb: 0% to 0.10%, Ca: 0% to 0.0030%, Mo: 0% to 0.5%, Cr: 0% to 1.0%, and Fe and impurities as a remainder, in which the sum of a Si content and an Al content is higher than 0.20% and lower than 0.81%, a microstructure includes, by area fraction, 90% to 99% of a ferrite, 1% to 10% of a martensite, and a bainite limited to 5% or less, a grain size of the martensite is 1 to 10 μm, an X-ray random intensity ratio of a {211}<011> orientation which is parallel to a rolled surface of the steel sheet and is parallel to a rolling direction is 3.0 or lower, and the tensile strength is 590 MPa or higher.

(2) The hot-rolled steel sheet described in (1) may include one or more of, as chemical composition, by mass %: Nb: 0.01% to 0.10%, Ca: 0.0005% to 0.0030%, Mo: 0.02% to 0.5%, and Cr: 0.02% to 1.0%.

(3) According to another aspect of the present invention, a production method of a hot-rolled steel sheet includes: a casting process of obtaining a slab by continuously casting a steel having the chemical composition described in (1) or (2); a heating process of heating the slab to a temperature range of 1200° C. or higher; a rough rolling process of performing a rough rolling on the heated slab; a finish rolling process of, after the rough rolling process, performing a continuous finish rolling on the slab using a finishing mill row having a plurality of rolling mills connected in series to cause a rolling reduction in a final pass to be 20% or higher and cause a finish rolling temperature to be 880° C. to 1000° C., thereby obtaining a steel sheet; a primary cooling process of performing a water cooling, which is started after 0.01 to 1.0 seconds from completion of the finish rolling process, on the steel sheet to a temperature range of 600° C. to 750° C. at a cooling rate of 30° C./s or higher; an air cooling process of performing an air cooling on the steel sheet for 3 to 10 seconds after the primary cooling process; a secondary cooling process of, after the air cooling process, performing a water cooling on the steel sheet to 200° C. or lower at a cooling rate of 30° C./s or higher; and a coiling process of coiling the steel sheet after the secondary cooling process.

Effects of the Invention

According to the aspects of the present invention, the hot-rolled steel sheet having the predetermined chemical composition, in which, in the microstructure, the structure fraction of a ferrite is 90% to 99%, the grain size of a martensite is 1 μm or greater and 10 μm or smaller, and the structure fraction of the martensite is 1% to 10%, the X-ray random intensity ratio of the {211}<011> orientation which is parallel to the rolled surface and is parallel to the rolling direction is 3.0 or lower, and the tensile strength is 590 MPa or higher can be obtained. The hot-rolled steel sheet has excellent external appearance and excellent balance between elongation and hole expansibility.

In addition, when the slab having the predetermined chemical composition is hot-rolled, by causing the finish rolling temperature to be 880° C. to 1000° C., recrystallization of austenite is promoted, and thus an improvement in the texture can be achieved. Furthermore, by causing the finish rolling reduction (the rolling reduction in the final pass) to be 20% or higher and starting water cooling for a time of 0.01 to 1.0 seconds after the end of the rolling, the recrystallization is completed within a short period of time, and finely recrystallized austenite can be made. During transformation from the finely recrystallized austenite, there are many ferrite nucleation sites, and transformation rapidly proceeds. Therefore, by performing air cooling thereafter, fine ferrite is formed. In addition, since residual austenite during air cooling finely remains, it becomes possible to refine martensite after the transformation. That is, according to the aspects of the present invention, a high strength hot-rolled steel sheet which has a predetermined microstructure and an X-ray random intensity ratio, excellent external appearance and excellent balance between elongation and hole expansibility, and a tensile strength of 590 MPa or higher can be produced.

EMBODIMENT OF THE INVENTION

Figure 1:
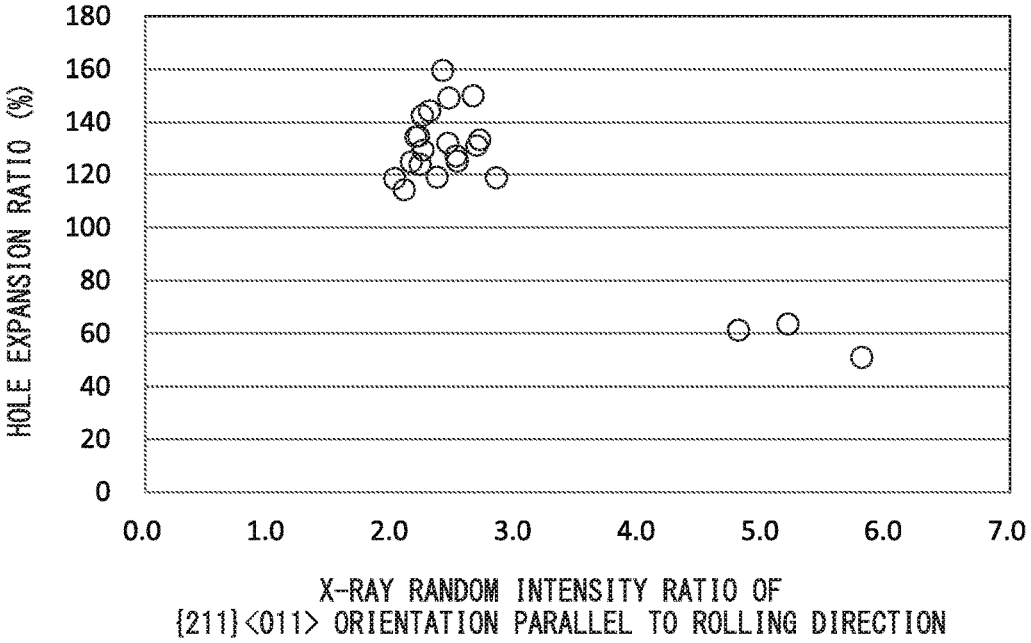
FIG. 1 is a view showing the relationship between an X-ray random intensity ratio and a hole expansion ratio.
Figure 2:
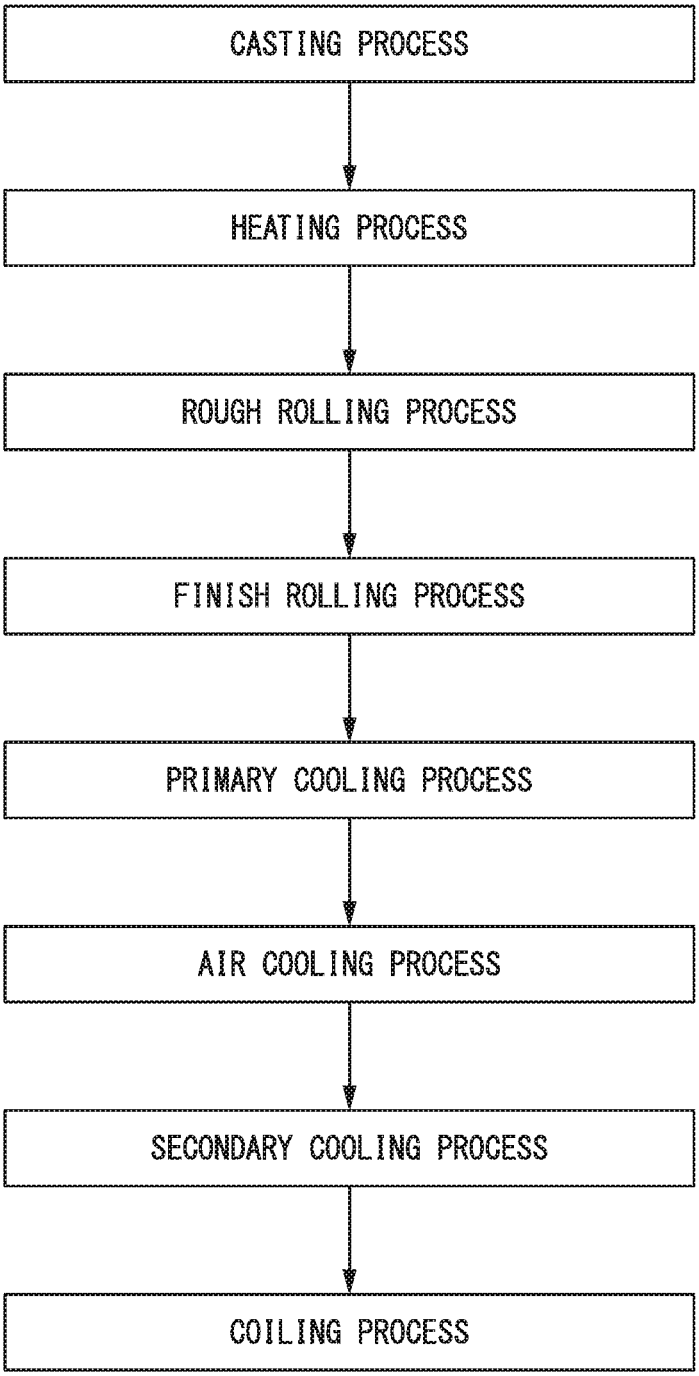
FIG. 2 is a flowchart showing an example of a production method of a hot-rolled steel sheet according to an embodiment.

Hereinafter, a hot-rolled steel sheet according to an embodiment of the present invention (hereinafter, sometimes referred to as a hot-rolled steel sheet according to this embodiment) will be described.

The hot-rolled steel sheet according to this embodiment is aimed at high strength hot-rolled steel sheets having a tensile strength of 590 MPa or higher. Regarding such a high strength hot-rolled steel sheet, in order to realize an enhancement in hole expansibility, it is effective that in the microstructure (metallographic structure) thereof the structure fraction (area fraction) of ferrite is 90% or higher and the structure fraction (area fraction) of martensite is 10% or lower. For example, the structure fraction and grain size of each structure may be obtained by performing image analysis on a structure photograph obtained from an optical micrograph (visual field: a visual field of 500×500 μm) of the steel sheet which is appropriately subjected to etching. For obtaining this structure, for example, as described in Patent Document 1, a method of performing air cooling (intermediate air cooling) on a steel sheet containing 0.5% or more of Si on a run-out table (hereinafter, referred to as ROT) in a hot-rolling process to promote ferritic transformation is considered. However, Si is a cause of generation of scale patterns due to Si scale. Therefore, when Si is contained, there is a problem of poor external appearance during use of the steel sheet.

On the other hand, in a case where Si is not added, in order to promote ferritic transformation, there is a need to reduce a finish rolling temperature. However, a reduction in the finish rolling temperature causes the development of the texture of the steel sheet. Specifically, {211}<110> which is parallel to a rolled surface and is parallel to a rolling direction is developed. When the texture is developed, anisotropy of plastic deformation becomes strong, and hole expansibility is deteriorated.

That is, an enhancement in balance between elongation and hole expansibility in a steel sheet which does not contain Si added thereto has not been achieved in the related art.

In the hot-rolled steel sheet of this embodiment, as an alternative to Si, ferritic transformation is promoted using Al. By causing a predetermined amount of Al to be contained, ferrite is transformed from fine austenite, and it becomes possible to avoid coarsening of the ferrite.

In addition, during finish rolling, a finish temperature is set to 880° C. to 1000° C. and a rolling reduction in the final pass is set to 20% or higher. At a time between 0.01 to 1.0 seconds after the end of the finish rolling, primary cooling is started. During the primary cooling, cooling is performed to 600° C. to 750° C. at a cooling rate of 30° C./s or higher. After the primary cooling, air cooling is performed for 3 to 10 seconds. After the air cooling, secondary cooling is performed to 200° C. or lower at a cooling rate of 30° C./s or higher, and the resultant is coiled. In the production method described above, a hot-rolled steel sheet in which the structure fraction of ferrite is 90% to 99%, the grain size of martensite is 1 to 10 μm, the structure fraction of martensite is 1% to 10%, an X-ray random intensity ratio of a {211}<011> orientation which is parallel to the rolled surface and is parallel to the rolling direction in the texture of the steel sheet is 3.0 or lower, and the tensile strength is 590 MPa or higher can be obtained. The hot-rolled steel sheet has excellent external appearance and excellent balance between elongation and hole expansibility.

Hereinafter, the hot-rolled steel sheet according to this embodiment will be described in detail.

First, the reason that the chemical composition limited will be described.

C: 0.02% to 0.10%

C is an important element to enhance the strength of the steel sheet. In order to obtain this effect, the lower limit of the C content is set to 0.02%. A preferable lower limit of the C content is 0.04%. On the other hand, when the C content is more than 0.10%, toughness is deteriorated, and the fundamental properties of the steel sheet cannot be secured. Therefore, the upper limit of the C content is set to 0.10%.

Si: 0.005% to 0.1%

Si is an element necessary for pre-deoxidation. Therefore, the lower limit of the Si content is set to 0.005%. On the other hand, since Si is an element that causes poor external appearance, and thus the upper limit of the Si content is set to 0.1%. The Si content is preferably less than 0.1%, more preferably 0.07% or less, and even more preferably 0.05% or less.

Mn: 0.5% to 2.0%

Mn is an element which contributes to an increase in the strength of the steel sheet by enhancing hardenability and causing solid solution strengthening. In order to obtain a desired strength, the lower limit of the Mn content is set to 0.5%. However, when the Mn content is excessive, MnS which is harmful to isotropy of toughness forms. Therefore, the upper limit of the Mn content is set to 2.0%.

P: 0.1% r or less

P is an impurity and is an element which has an adverse effect on workability and weldability and reduces fatigue properties. Therefore, the P content is preferably as low as possible. However, in view of dephosphorizing costs, the lower limit thereof may be set to 0.0005%. When the P content is more than 0.1%, the adverse effect becomes significant, and thus the P content is limited to 0.1% or less.

S: 0.01% or less

S forms inclusions such as MnS which is harmful to isotropy of toughness. Therefore, the S content is preferably as low as possible. However, in view of desulfurizing costs, the lower limit thereof may be set to 0.0005%. When the S content is more than 0.01%, the adverse effect becomes significant, and thus the S content is limited to 0.01% or less. In a case where particularly strict low temperature toughness is required, the S content is preferably limited to 0.006% or less.

Al: 0.2% to 0.8%

Al is an important element for the hot-rolled steel sheet according to this embodiment. In order to promote ferritic transformation during cooling on the ROT after the finish rolling, the lower limit of the Al content is set to 0.2%. However, when the Al content is excessive, alumina precipitated in a cluster form forms, resulting in a deterioration in toughness. Therefore, the upper limit of the Al content is set to 0.8%.

N: 0.01% or less

N is an element that forms precipitates of Ti in a higher temperature range than that of S. When the N content is excessive, not only is the amount of Ti effective in fixing S reduced, but also coarse Ti nitrides forms, resulting in a deterioration in the toughness of the steel sheet. Therefore, the N content is limited to 0.01% or less.

Ti: 0.01% to 0.11%

Ti is an element that enhances the strength of the steel sheet through precipitation strengthening. In order to achieve precipitation strengthening of ferrite and excellent balance between elongation and hole expansibility, the lower limit of the Ti content is set to 0.01%. However, when the Ti content is more than 0.11%, inclusions caused by TiN form, and hole expansibility is deteriorated. Therefore, the upper limit of the Ti content is set to 0.11%.

0.20%<Si+Al<0.81%

Both Si and Al are elements that promote ferritic transformation. When Si+Al, which is the sum of the Si content and the Al content is 0.20% or less, ferritic transformation does not proceed during intermediate air cooling, and a desired ferrite structure fraction cannot be obtained during ROT cooling. On the other hand, when Si+Al is 0.81% or more, a ferritic transformation temperature excessively increases, and ferritic transformation occurs during rolling, which strengthens anisotropy of the texture. Si+Al is preferably more than 0.20% and 0.60% or less.

The hot-rolled steel sheet according to this embodiment basically has the above-described chemical composition and Fe and impurities as the remainder. However, in order to reduce production variations and further enhance strength, one or more selected from Nb, Ca, Mo, and Cr may be further contained in the following ranges. These chemical composition do not necessarily added to the steel sheet, and thus the lower limits thereof are 0%.

Nb: 0.01% to 0.10%

Nb can increase the strength of the steel sheet by reducing the grain size of the hot-rolled steel sheet and causing precipitation strengthening of NbC. In a case of obtaining these effects, the Nb content is preferably set to 0.01% or more. On the other hand, when the Nb content is more than 0.10%, the effects are saturated. Therefore, the upper limit of the Nb content is set to 0.10%.

Ca: 0.0005% to 0.0030%

Ca has an effect of dispersing a large amount of fine oxides in molten steel and refining the structure. In addition, Ca is an element which enhances the hole expansibility of the steel sheet by fixing S in the molten steel as spheroidal CaS and suppressing the generation of elongated inclusions such as MnS. In a case of obtaining these effects, the Ca content is preferably set to 0.0005% or more. On the other hand, even when the Ca content exceeds 0.0030%, these effects are saturated, and thus the upper limit of the Ca content is set to 0.0030%.

Mo: 0.02% to 0.5%

Mo is an element effective in precipitation strengthening of ferrite. In a case of obtaining this effect, the Mo content is preferably set to 0.02% or more. However, when the Mo content is excessive, sensitivity to cracking in a slab increases, and it becomes difficult to handle the slab. Therefore, the upper limit of the Mo content is set to 0.5%.

Cr: 0.02% to 1.0%

Cr is an element effective in enhancing the strength of the steel sheet. In a case of obtaining this effect, the Cr content is preferably set to 0.02% or more. However, when the Cr content is excessive, elongation decreases. Therefore, the upper limit of the Cr content is set to 1.0%.

Next, the microstructure and the X-ray random intensity ratio of the hot-rolled steel sheet according to this embodiment will be described.

As a steel sheet which achieves both high strength and high elongation, there is a combined structure steel which is a steel sheet in which a hard structure such as martensite is dispersed in ferrite which is soft and has excellent elongation. The combined structure steel has high strength and high elongation. However, in the combined structure steel, high strain is concentrated in the vicinity of the hard structure, and a crack propagation speed is high, resulting in a problem of low hole expansibility.

In order to limit the deterioration in the hole expansibility caused by the presence of martensite, it is effective that the grain size of the martensite is 10 μm or smaller and the structure fraction (area fraction) of the martensite in the microstructure is 10% or lower. On the other hand, in order to secure fatigue properties and balance between elongation and strength, the area fraction of the martensite needs to be 1% or higher. In addition, in a case where the area fraction of the martensite is reduced to 10% or lower in order to suppress the deterioration in the hole expansibility, there is concern that sufficient strength may not be obtained. Therefore, in the hot-rolled steel sheet according to this embodiment, for enhancing strength while securing elongation, ferrite which undergoes precipitation strengthening due to Ti needs to be contained in an area fraction of 90% or higher. However, when Ti is contained in the steel sheet for the purpose of precipitation strengthening, recrystallization of austenite during finish rolling is suppressed, and thus a strong deformation texture is formed due to the finish rolling. This deformation texture is transferred even after transformation, and a texture in the steel sheet after the transformation indicates a strong integration degree. Accordingly, the hole expansibility is deteriorated. Here, in the hot-rolled steel sheet according to this embodiment, in addition to optimization of the area fractions of the ferrite and the martensite, as an index of the texture of the steel sheet, the X-ray random intensity ratio of a {211}<011> orientation which is parallel to the rolled surface and is parallel to the rolling direction is caused to be 3.0 or lower. By causing the structure fraction and the texture to be in optimal ranges, high elongation and hole expansibility can be compatible with each other.

In addition, bainite is poorer in elongation and hole expansibility than ferrite and thus causes a smaller increase in strength than martensite. Therefore, for the reason that it is difficult to cause elongation and hole expansibility to be compatible with each other, it is preferable that the area fraction of the bainite is limited to 5% or lower. In the hot-rolled steel sheet according to this embodiment, the area fractions of structures other than the ferrite, martensite, and bainite do not need to be specified.

Next, a production method of the hot-rolled steel sheet according to this embodiment will be described.

First, by continuously casting a steel having the above-described chemical composition, a continuously cast slab (hereinafter, referred to as a slab) is obtained (casting process). Before hot-rolling, the slab is heated to 1200° C. or higher (heating process). In a case where the slab is heated at a temperature of lower than 1200° C., TiC is not sufficiently melted in the slab, and thus the amount of Ti necessary for precipitation strengthening of ferrite is insufficient. On the other hand, when the heating temperature is 1300° C. or higher, the amount of scale generated or maintenance costs for a heating furnace increase, which is not preferable.

The heated slab is subjected to rough rolling (rough rolling process), and is further subjected to continuous finish rolling in a finishing mill row having a plurality of rolling mills connected in series (finish rolling process). At this time, a final rolling reduction of the finish rolling (a rolling reduction in the final pass of the finish rolling) is caused to be 20% or higher, and a finish temperature FT (a temperature at the completion of the final pass) of the final finish rolling is caused to be 880° C. to 1000° C. In order to cause recrystallization of austenite to occur at a high temperature, as the rolling reduction of the final pass, a rolling reduction of 20% or higher is necessary. When the rolling reduction of the final pass is lower than 20%, driving power necessary for recrystallization is insufficient, and grain growth occurs at a time between the completion of the final pass of the finish rolling and the start of cooling. As a result, martensite becomes coarsened and hole expansibility is deteriorated. When the finish rolling temperature is lower than 880° C., recrystallization of austenite does not proceed, the texture of the steel sheet is developed, and the X-ray random intensity ratio of the {211}<011> orientation which is parallel to the rolled surface and is parallel to the rolling direction becomes higher than 3.0, resulting in the deterioration in hole expansibility. When the finish rolling temperature is higher than 1000° C., the grain size of austenite is coarsened, a dislocation density rapidly decreases, and thus ferritic transformation is significantly delayed. As a result, a ferrite structure fraction of 90% or higher cannot be obtained.

In order to more reliably recrystallize austenite, the finish rolling temperature is preferably set to 900° C. or higher.

Subsequent to the finish rolling, primary cooling is performed (primary cooling process). The primary cooling is started at a time between 0.01 to 1.0 seconds after the completion of the finish rolling. Although water cooling is performed during the primary cooling, in order to complete the recrystallization of austenite after the rolling, air cooling needs to be performed for 0.01 seconds or longer from the completion of the finish rolling to the start of the primary cooling. In order to reliably complete the recrystallization, the time from the completion of the finish rolling to the start of the primary cooling is preferably set to 0.02 seconds or longer, and more preferably 0.05 seconds or longer. However, when the air cooling time increases, grains of the recrystallized austenite become coarsened, ferritic transformation is significantly delayed, and coarse martensite forms. In order to suppress voids generated at the interface between ferrite and martensite and obtain excellent hole expansibility, it is important to cause the grain size of the martensite to be 10 μm or smaller. For this, there is a need to suppress grain coarsening of the austenite. Therefore, the primary cooling is started within 1.0 seconds after the completion of the finish rolling.

The primary cooling after the finish rolling is performed to cause a cooling stop temperature to be in a temperature range of 600° C. to 750° C. at a cooling rate of 30° C./s or higher. In addition, after the completion of the primary cooling, intermediate air cooling is performed for 3 to 10 seconds in this temperature range (air cooling process). Fine austenite has a fast rate of grain elongation, and grain growth occurs during cooling at a cooling rate of lower than 30° C./s, resulting in a coarse structure. On the other hand, when the cooling rate of the primary cooling is too fast, a temperature distribution easily occurs in the thickness direction of the steel sheet. When a temperature distribution is present in the thickness direction, the grain sizes of ferrite and martensite vary between the steel sheet central part and the surface part, and there is concern that material variations increase. Therefore, the cooling rate of the primary cooling is preferably set to 100° C./s or lower. When the cooling stop temperature and a temperature range in which the air cooling is performed are lower than 600° C., ferritic transformation is delayed, a high ferrite fraction is not obtained, and elongation is deteriorated. On the other hand, when the cooling stop temperature and the temperature range in which the air cooling is performed are higher than 750° C., coarse TiC is precipitated in the ferrite. Therefore, precipitation strengthening of the ferrite is not sufficiently achieved, and a tensile strength of 590 MPa is not obtained. The intermediate air cooling needs to be performed 3 seconds or longer in order to cause ferritic transformation. However, during air cooling for longer than 10 seconds, precipitation of bainite proceeds, and elongation and hole expansibility are deteriorated.

After the intermediate air cooling, secondary cooling for cooling the steel sheet to 200° C. or lower is performed at a cooling rate of 30° C./s or higher (secondary cooling process) and the resultant is coiled (coiling process). When the cooling rate of the secondary cooling is lower than 30° C./s, bainitic transformation proceeds, and martensite cannot be obtained. In this case, the tensile strength is decreased, and elongation is deteriorated. On the other hand, when the cooling rate of the secondary cooling is too fast, a temperature distribution easily occurs in the thickness direction of the steel sheet. When a temperature distribution is present in the thickness direction, the grain sizes of ferrite and martensite vary between the steel sheet central part and the surface part, and there is concern that material variations increase. Therefore, the cooling rate of the secondary cooling is preferably set to 100° C./s or lower. When the cooling stop temperature is higher than 200° C., a self-tempering effect of martensite occurs. When the self-tempering occurs, the tensile strength is decreased, and elongation is deteriorated.

[Example]

Steel containing components shown in Table 1 was melted in a converter and was continuously cast into a slab having a thickness of 230 mm. Thereafter, the slab was heated to a temperature of 1200° C. to 1250° C. and was subjected to rough rolling and finish rolling by a continuous hot-rolling apparatus, and the resultant was coiled after ROT cooling, thereby producing a hot-rolled steel sheet. Table 2 shows steel type symbols used, hot-rolling conditions, and steel sheet thicknesses. In Table 2, "FT6" is the temperature at the time of the completion of the final finish pass, "cooling start time" is the time from the finish rolling to the start of primary cooling, "primary cooling" is the average cooling rate until an intermediate air cooling temperature is reached after the end of the finish rolling, "intermediate temperature" is the intermediate air cooling temperature after the primary cooling, "intermediate time" is the intermediate air cooling time after the primary cooling, "secondary cooling" is the average cooling rate until coiling is performed after the intermediate air cooling, and "coiling temperature" is the temperature after the end of the secondary cooling.

TABLE 1

| Steel | Components (mass %) | | | | | | | | | | | | |
|---|---|---|---|---|---|---|---|---|---|---|---|---|---|
| type | C | Si | Mn | P | S | Al | N | Ti | Nb | Ca | Mo | Cr | Si + Al |
| A | 0.04 | 0.01 | 0.6 | 0.015 | 0.0030 | 0.22 | 0.004 | 0.04 | — | — | — | — | 0.23 |
| B | 0.04 | 0.01 | 0.6 | 0.014 | 0.0042 | 0.31 | 0.004 | 0.04 | 0.02 | — | — | — | 0.32 |
| C | 0.04 | 0.03 | 1.0 | 0.014 | 0.0030 | 0.31 | 0.003 | 0.04 | 0.02 | 0.002 | — | — | 0.34 |
| D | 0.06 | 0.02 | 1.4 | 0.015 | 0.0010 | 0.31 | 0.004 | 0.04 | — | — | 0.2 | — | 0.33 |
| E | 0.06 | 0.05 | 1.4 | 0.015 | 0.0013 | 0.52 | 0.003 | 0.06 | — | 0.002 | 0.2 | — | 0.57 |
| F | 0.06 | 0.05 | 1.8 | 0.014 | 0.0030 | 0.52 | 0.004 | 0.06 | — | — | — | 0.3 | 0.57 |
| G | 0.08 | 0.05 | 1.8 | 0.013 | 0.0060 | 0.55 | 0.003 | 0.06 | 0.02 | — | 0.3 | — | 0.60 |
| H | 0.08 | 0.05 | 1.2 | 0.015 | 0.0050 | 0.10 | 0.004 | 0.06 | — | — | | — | 0.15 |
| I | 0.07 | 0.20 | 1.5 | 0.015 | 0.0030 | 0.52 | 0.004 | 0.08 | 0.02 | 0.002 | — | — | 0.72 |

TABLE 2

| No. | Steel type | Final pass reduction % | FT6 ° C. | Cooling start time second | Primary cooling ° C./s | Intermediate temperature ° C. | Intermediate time second | Secondary cooling ° C./s | Coiliing temperature ° C. | Sheet thickness mm |
|---|---|---|---|---|---|---|---|---|---|---|
| 1 | A | 30 | 960 | 0.5 | 40 | 703 | 7 | 68 | 100 | 2.3 |
| 2 | A | 30 | 999 | 0.7 | 43 | 783 | 4 | 45 | 100 | 2.3 |
| 3 | A | 30 | 955 | 0.7 | 48 | 658 | 4 | 79 | 100 | 2.3 |
| 4 | A | 30 | 975 | 0.8 | 34 | 668 | 7 | 50 | 100 | 2.3 |
| 5 | A | 40 | 830 | 0.8 | 35 | 696 | 7 | 69 | 100 | 2.3 |
| 6 | B | 40 | 938 | 0.5 | 38 | 680 | 7 | 74 | 100 | 2.6 |
| 7 | B | 40 | 917 | 0.7 | 39 | 717 | 8 | 44 | 100 | 2.6 |
| 8 | B | 40 | 962 | 3.2 | 45 | 684 | 6 | 73 | 100 | 2.6 |
| 9 | B | 40 | 975 | 0.4 | 34 | 674 | 8 | 59 | 150 | 2.6 |
| 10 | C | 40 | 930 | 0.7 | 49 | 685 | 7 | 63 | 150 | 2.6 |
| 11 | C | 40 | 948 | 0.4 | 41 | 663 | 3 | 44 | 150 | 2.6 |
| 12 | C | 40 | 994 | 0.4 | 37 | 689 | 1 | 48 | 150 | 2.6 |
| 13 | C | 40 | 976 | 0.6 | 40 | 703 | 8 | 61 | 150 | 2.6 |
| 14 | C | 40 | 940 | 0.3 | 50 | 698 | 5 | 75 | 150 | 3.2 |
| 15 | D | 40 | 949 | 0.4 | 47 | 698 | 8 | 59 | 150 | 3.2 |
| 16 | D | 30 | 994 | 0.7 | 38 | 696 | 15 | 70 | 150 | 3.2 |
| 17 | D | 30 | 969 | 0.4 | 38 | 582 | 6 | 38 | 150 | 3.2 |
| 18 | D | 30 | 990 | 0.5 | 36 | 689 | 4 | 60 | 150 | 3.2 |
| 19 | E | 30 | 957 | 0.5 | 36 | 700 | 7 | 38 | 150 | 4.8 |
| 20 | E | 26 | 1100 | 0.5 | 34 | 678 | 4 | 42 | 150 | 4.8 |
| 21 | E | 26 | 923 | 0.7 | 31 | 710 | 8 | 53 | 150 | 4.8 |
| 22 | E | 26 | 977 | 0.8 | 40 | 719 | 5 | 57 | 430 | 4.8 |

TABLE 2-continued

| No. | Steel type | Final pass reduction % | FT6 ° C. | Cooling start time second | Primary cooling ° C./s | Intermediate temperature ° C. | Intermediate time second | Secondary cooling ° C./s | Coiliing temperature ° C. | Sheet thickness mm |
|---|---|---|---|---|---|---|---|---|---|---|
| 23 | F | 26 | 985 | 0.5 | 30 | 652 | 5 | 59 | 100 | 4.8 |
| 24 | F | 15 | 964 | 0.3 | 48 | 652 | 4 | 77 | 100 | 4.8 |
| 25 | F | 26 | 917 | 0.4 | 31 | 677 | 3 | 71 | 100 | 2.3 |
| 26 | G | 26 | 948 | 0.6 | 42 | 716 | 7 | 49 | 100 | 2.3 |
| 27 | G | 26 | 944 | 0.4 | 33 | 685 | 5 | 77 | 100 | 2.6 |
| 28 | G | 30 | 934 | 0.7 | 50 | 680 | 7 | 45 | 100 | 2.6 |
| 29 | H | 30 | 957 | 0.4 | 47 | 674 | 7 | 66 | 100 | 2.6 |
| 30 | I | 30 | 995 | 0.6 | 43 | 694 | 6 | 54 | 100 | 2.3 |
| 31 | G | 30 | 957 | 0.0 | 63 | 678 | 5 | 59 | 100 | 2.3 |
| 32 | G | 30 | 963 | 0.3 | 20 | 653 | 4 | 77 | 100 | 2.3 |
| 33 | G | 30 | 948 | 0.3 | 48 | 682 | 5 | 15 | 100 | 2.3 |

TABLE 3

| | Area fraction of each structure (%) | | | Grain size of martensite | Texture | Yield strength | Tensile strength | Elon-gation | Hole expansion ratio | External | |
|---|---|---|---|---|---|---|---|---|---|---|---|
| No. | Ferrite | Martensite | Bainite | μm | Xrandom | MPa | MPa | % | % | appearance | Note |
| 1 | 92 | 8 | 0 | 2 | 2.2 | 455 | 635 | 26 | 134 | G | Present Invention Example |
| 2 | 93 | 7 | 0 | 3 | 2.8 | 460 | 561 | 31 | 137 | G | Comparative Example |
| 3 | 91 | 9 | 0 | 3 | 2.2 | 439 | 619 | 28 | 129 | G | Present Invention Example |
| 4 | 94 | 6 | 0 | 3 | 2.4 | 443 | 611 | 27 | 160 | G | Present Invention Example |
| 5 | 98 | 2 | 0 | 6 | 5.2 | 522 | 660 | 29 | 64 | G | Comparative Example |
| 6 | 90 | 10 | 0 | 4 | 2.2 | 500 | 590 | 28 | 125 | G | Present Invention Example |
| 7 | 93 | 7 | 0 | 4 | 2.2 | 598 | 691 | 26 | 135 | G | Present Invention Example |
| 8 | 73 | 27 | 0 | 5 | 2.6 | 520 | 781 | 12 | 55 | G | Comparative Example |
| 9 | 95 | 5 | 0 | 3 | 2.7 | 478 | 666 | 28 | 150 | G | Present Invention Example |
| 10 | 95 | 5 | 0 | 5 | 2.2 | 484 | 653 | 29 | 142 | G | Present Invention Example |
| 11 | 92 | 8 | 0 | 2 | 2.5 | 448 | 591 | 32 | 127 | G | Present Invention Example |
| 12 | 63 | 37 | 0 | 7 | 2.7 | 516 | 639 | 17 | 49 | G | Comparative Example |
| 13 | 93 | 7 | 0 | 5 | 2.7 | 535 | 634 | 29 | 131 | G | Present Invention Example |
| 14 | 92 | 8 | 0 | 5 | 2.5 | 435 | 610 | 27 | 149 | G | Present Invention Example |
| 15 | 92 | 8 | 0 | 3 | 2.5 | 674 | 822 | 22 | 125 | G | Present Invention Example |
| 16 | 92 | 0 | 8 | — | 2.8 | 653 | 843 | 12 | 64 | G | Comparative Example |
| 17 | 63 | 37 | 0 | 3 | 2.7 | 649 | 802 | 18 | 49 | G | Comparative Example |
| 18 | 93 | 7 | 0 | 5 | 2.8 | 613 | 828 | 24 | 119 | G | Present Invention Example |
| 19 | 94 | 6 | 0 | 3 | 2.4 | 706 | 804 | 24 | 132 | G | Present Invention Example |
| 20 | 81 | 19 | 0 | 5 | 1.8 | 705 | 804 | 19 | 74 | G | Comparative Example |
| 21 | 92 | 8 | 0 | 6 | 2.0 | 731 | 844 | 23 | 118 | G | Present Invention Example |
| 22 | 93 | 0 | 7 | — | 2.6 | 659 | 581 | 18 | 42 | G | Comparative Example |
| 23 | 94 | 6 | 0 | 6 | 2.7 | 633 | 746 | 26 | 133 | G | Present Invention Example |
| 24 | 92 | 8 | 0 | 14 | 4.8 | 598 | 770 | 22 | 61 | G | Comparative Example |
| 25 | 91 | 9 | 0 | 6 | 2.1 | 680 | 757 | 24 | 114 | G | Present Invention Example |
| 26 | 94 | 6 | 0 | 4 | 2.3 | 622 | 864 | 21 | 144 | G | Present Invention Example |

TABLE 3-continued

| No. | Area fraction of each structure (%) Ferrite | Martensite | Bainite | Grain size of martensite μm | Texture Xrandom | Yield strength MPa | Tensile strength MPa | Elon-gation % | Hole expansion ratio % | External appearance | Note |
|---|---|---|---|---|---|---|---|---|---|---|---|
| 27 | 91 | 9 | 0 | 2 | 2.2 | 564 | 792 | 23 | 124 | G | Present Invention Example |
| 28 | 92 | 8 | 0 | 6 | 2.4 | 681 | 858 | 23 | 119 | G | Present Invention Example |
| 29 | 53 | 47 | 0 | 6 | 2.2 | 686 | 836 | 8 | 64 | G | Comparative Example |
| 30 | 90 | 10 | 0 | 2 | 2.7 | 638 | 859 | 22 | 107 | B | Comparative Example |
| 31 | 93 | 7 | 0 | 2 | 5.8 | 481 | 676 | 28 | 51 | G | Comparative Example |
| 32 | 92 | 8 | 0 | 21 | 2.2 | 488 | 663 | 24 | 61 | G | Comparative Example |
| 33 | 85 | 1 | 14 | 4 | 2.5 | 458 | 601 | 17 | 58 | G | Comparative Example |

The structure fractions of ferrite, bainite, and martensite and the texture of the obtained steel sheet were analyzed using an optical microscope. In addition, the grain size of the martensite was inspected.

Regarding the structure fractions of the ferrite and bainite of the steel sheet, the area fractions thereof were obtained by performing image analysis on a structure photograph obtained from a visual field of 500×500 μm after nital etching using the optical microscope. Regarding the grain size and structure fraction of the martensite, the area fraction and grain size thereof were obtained using image analysis performed on a structure photograph obtained from a visual field of 500×500 μm after lepera etching using the optical microscope.

For analysis of the texture, the X-ray random intensity ratio of a {211}<011> orientation which was parallel to the rolled surface and was parallel to the rolling direction at a sheet thickness ¼ portion which is a ¼ position from the surface in the thickness direction was evaluated. Using the electron back scattering diffraction pattern (EBSD) method, at a pixel measurement interval of ⅕ of the average grain size or smaller, measurement was performed on a region where 5000 or more grains could be measured, and the X-ray random intensity ratio was measured from the distribution of the orientation distribution function (ODF). In addition, an X-ray random intensity ratio of 3.0 or lower was evaluated as pass.

In a tensile test of the steel sheet, a JIS 5 test piece was extracted in a rolling width direction (C direction) of the steel sheet, and yield strength: YP (MPa), tensile strength: TS (MPa), and elongation: EL (%) were evaluated on the basis of JIS Z 2241.

Hole expansion ratio: regarding λ (%), evaluation was performed according to a method specified in ISO 16630.

For evaluation of the external appearance of the steel sheet, a steel sheet was cut into 500 mm in the longitudinal direction at a 10 m position of the outer circumference of a hot-rolled coil, and the area fraction of a scale pattern was measured. Those having a scale pattern area fraction of 10% or lower were evaluated as "G: GOOD". On the other hand, those having a scale pattern area fraction of higher than 10% were evaluated as "B: BAD".

Table 3 shows evaluation results of the structure fraction (area fraction) of each structure, the martensite grain size, the texture, the material quality, and the external appearance.

As shown in Table 3, in present invention examples, the tensile strength was 590 MPa or higher, the structure fraction of ferrite was 90% or higher, the grain size of martensite was 10 μm or smaller, the structure fraction thereof was 1% to 10%, and the X-ray random intensity ratio of the {211}<011> orientation which was parallel to the rolled surface and was parallel to the rolling direction was 3.0 or lower. That is, all of the present invention example had excellent external appearance and excellent balance between elongation and hole expansibility.

Contrary to this, in No. 2, since the intermediate air cooling temperature was high, coarse Ti was precipitated in ferrite, and sufficient precipitation strengthening could not be obtained. Therefore, the tensile strength was lower than 590 MPa.

In No. 5, since the finish temperature was lower than 880° C., the steel sheet texture had strong anisotropy, and hole expansibility was deteriorated.

In No. 8, since the time after the finish rolling to the start of the primary cooling was longer than 1.0 seconds, coarsening of the austenite structure had proceeded, and ferritic transformation was significantly delayed. Therefore, elongation and hole expansibility were deteriorated.

In No. 12, since the intermediate air cooling time was shorter than 3 seconds, ferritic transformation could not be sufficiently proceeded. Therefore, elongation and hole expansibility were deteriorated.

In No. 16, since the intermediate air cooling time was longer than 10 seconds, bainitic transformation had proceeded, and thus the structure fraction of martensite could not be obtained. Therefore, elongation and hole expansibility were deteriorated.

In No. 17, since the intermediate air cooling temperature was lower than 600° C., the structure fraction of ferrite could not be obtained. Therefore, elongation and hole expansibility were deteriorated.

In No. 20, since the finish temperature was higher than 1000° C., ferritic transformation was delayed due to coarsening of the austenite structure. Therefore, elongation and hole expansibility were deteriorated.

In No. 22, since the coiling temperature was higher than 200° C., martensite could not be obtained but bainite had formed. Therefore, the tensile strength was lower than 590 MPa, and elongation and hole expansibility were deteriorated.

In No. 24, since the rolling reduction in the final pass was lower than 20%, martensite become coarsened and exceeded 10 μm. Therefore, hole expansibility was deteriorated. In addition, since recrystallization of austenite was insufficient, the anisotropy of the steel sheet texture was strong, and thus hole expansibility was deteriorated.

In No. 29, since the Al content was less than 0.2 mass %, ferritic transformation did not proceed, and elongation and hole expansibility were deteriorated.

In No. 30, since the Si content was more than 0.1 mass %, a large number of scale patterns could be seen from the external appearance, and the area fraction of the scale patterns was higher than 10% with respect to the total area fraction.

In No. 31, since the time after the finish rolling to the start of the primary cooling was shorter than 0.01 seconds, recrystallization could not be sufficiently proceeded, and the texture was developed. Therefore, hole expansibility was deteriorated.

In No. 32, since the cooling rate of the primary cooling was lower than 30° C./s, the grain size of martensite was greater than 10 μm, and hole expansibility was deteriorated.

In No. 33, since the cooling rate of the secondary cooling was lower than 30° C./s, bainite during cooling exceeded 5%. Therefore, elongation and hole expansibility were deteriorated.

INDUSTRIAL APPLICABILITY

According to the embodiment of the present invention, a hot-rolled steel sheet having predetermined chemical composition, in which, regarding the proportions of structures, the structure fraction of ferrite is 90% to 99%, the grain size of martensite is 1 μm to 10 μm and the structure fraction thereof is 1% to 10%, the X-ray random intensity ratio of a {211}<011> orientation which is parallel to a rolled surface and is parallel to a rolling direction is 3.0 or lower, and the tensile strength is 590 MPa or higher can be obtained. The hot-rolled steel sheet has excellent external appearance and excellent balance between elongation and hole expansibility.

What is claimed is:

1. A hot-rolled steel sheet comprising, as chemical composition, by mass %:

C: 0.02% to 0.10%,
Si: 0.005% to 0.1%,
Mn: 0.5% to 2.0%,
P: 0.1% or less,
S: 0.01% or less,
Al: 0.2% to 0.8%,
N: 0.01% or less,
Ti: 0.01% to 0.11%,
Nb: 0% to 0.10%,
Ca: 0% to 0.0030%,
Mo: 0% to 0.5%,
Cr: 0% to 1.0%, and
Fe and impurities as a remainder, wherein a sum of a Si content and an Al content is higher than 0.20% and lower than 0.81%, a microstructure includes, by area fraction, 90% to 99% of a ferrite, 1% to 10% of a martensite, and a bainite limited to 5% or less, a grain size of the martensite is 1 to 10 μm, an X-ray random intensity ratio of a {211}<011> orientation which is parallel to a rolled surface of the steel sheet and is parallel to a rolling direction is 3.0 or lower, and a tensile strength of the hot-rolled steel sheet is 590 MPa or higher, an elongation of the hot-rolled steel sheet is 20% or higher, and a hole expansion ratio of the hot-rolled steel sheet is 100% or higher.

2. The hot-rolled steel sheet according to claim 1, comprising one or more of, as chemical composition, by mass %:

Nb: 0.01% to 0.10%,
Ca: 0.0005% to 0.0030%,
Mo: 0.02% to 0.5%, and
Cr: 0.02% to 1.0%.

3. A production method of a hot-rolled steel sheet comprising:

a casting process of obtaining a slab by continuously casting a steel having the chemical composition according to claim 1;

a heating process of heating the slab to a temperature range of 1200° C. or higher;

a rough rolling process of performing a rough rolling on the heated slab;

a finish rolling process of, after the rough rolling process, performing a continuous finish rolling on the slab using a finishing mill row having a plurality of rolling mills connected in series to cause a rolling reduction in a final pass to be 20% or higher and cause a finish rolling temperature to be 880° C. to 1000° C., thereby obtaining a steel sheet;

a primary cooling process of performing a water cooling, which is started after 0.01 to 1.0 seconds from a completion of the finish rolling process, on the steel sheet to a temperature range of 600° C. to 750° C. at a cooling rate of 30° C./s or higher;

an air cooling process of performing an air cooling on the steel sheet for 3 to 10 seconds after the primary cooling process;

a secondary cooling process of, after the air cooling process, performing a water cooling on the steel sheet to 200° C. or lower at a cooling rate of 30° C./s or higher; and a coiling process of coiling the steel sheet after the secondary cooling process.

4. A production method of a hot-rolled steel sheet comprising:

a casting process of obtaining a slab by continuously casting a steel having the chemical composition according to claim 2;

a heating process of heating the slab to a temperature range of 1200° C. or higher;

a rough rolling process of performing a rough rolling on the heated slab;

a finish rolling process of, after the rough rolling process, performing a continuous finish rolling on the slab using a finishing mill row having a plurality of rolling mills connected in series to cause a rolling reduction in a final pass to be 20% or higher and cause a finish rolling temperature to be 880° C. to 1000° C., thereby obtaining a steel sheet;

a primary cooling process of performing a water cooling, which is started after 0.01 to 1.0 seconds from a completion of the finish rolling process, on the steel sheet to a temperature range of 600° C. to 750° C. at a cooling rate of 30° C./s or higher;

an air cooling process of performing an air cooling on the steel sheet for 3 to 10 seconds after the primary cooling process;

a secondary cooling process of, after the air cooling process, performing a water cooling on the steel sheet to 200° C. or lower at a cooling rate of 30° C./s or higher; and a coiling process of coiling the steel sheet after the secondary cooling process.

* * * * *